US009560445B2

(12) United States Patent
Raghuvanshi et al.

(10) Patent No.: US 9,560,445 B2
(45) Date of Patent: Jan. 31, 2017

(54) ENHANCED SPATIAL IMPRESSION FOR HOME AUDIO

(71) Applicant: Microsoft Corporation, Redmond, WA (US)

(72) Inventors: Nikunj Raghuvanshi, Redmond, WA (US); Daniel Morris, Bellevue, WA (US); Andrew D. Wilson, Seattle, WA (US); Yong Rui, Beijing (CN); Desney S. Tan, Kirkland, WA (US); Jeannette M. Wing, Bellevue, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 14/158,796

(22) Filed: Jan. 18, 2014

(65) Prior Publication Data

US 2015/0208166 A1 Jul. 23, 2015

(51) Int. Cl.

| | |
|---|---|
| ***H04R 5/02*** | (2006.01) |
| ***H04R 3/00*** | (2006.01) |
| ***H04S 7/00*** | (2006.01) |

(52) U.S. Cl.

CPC ..... *H04R 3/002* (2013.01); *H04S 7/303* (2013.01); *H04R 2201/403* (2013.01); *H04R 2203/12* (2013.01); *H04R 2217/03* (2013.01)

(58) Field of Classification Search

CPC ..... H04S 7/303; H04R 2203/12
USPC ..... 381/71.6, 307, 309
See application file for complete search history.

(56) References Cited

U.S. PATENT DOCUMENTS

| | | | |
|---|---|---|---|
| 2005/0135643 | A1 | 6/2005 | Lee et al. |
| 2007/0211574 | A1 | 9/2007 | Croft |
| 2008/0025534 | A1* | 1/2008 | Kuhn et al. ..... 381/300 |

(Continued)

FOREIGN PATENT DOCUMENTS

| | | | |
|---|---|---|---|
| JP | 2007142909 | A | 6/2007 |
| WO | 2012068174 | A2 | 5/2012 |

OTHER PUBLICATIONS

Casey, et al., "Vision Steered Beam-forming and Transaural Rendering for the Artificial Life Interactive Video Environment, (ALIVE)", In Audio Engineering Society Convention, Audio Engineering Society, Oct. 1995, 28 pages.

(Continued)

*Primary Examiner* — Paul S Kim
*Assistant Examiner* — Katherine Faley
(74) *Attorney, Agent, or Firm* — Steve Wight; Sandy Swain; Micky Minhas

(57) ABSTRACT

Technologies pertaining to provision of customized audio to each listener in a plurality of listeners are described herein. A sensor outputs data that is indicative of locations of multiple listeners in an environment. The data is processed to determine locations and orientations of the respective heads of the multiple listener in the environment. Based on the locations and orientations of heads of the listeners in the environment, for each listener, respective customized audio signals are generated. The customized audio signals are transmitted to respective beamforming transducers. The beamforming transducers directionally output customized beams for the first listener and the second listener based upon the customized audio signals and locations of the heads of the listeners.

20 Claims, 7 Drawing Sheets

(56) References Cited

U.S. PATENT DOCUMENTS

| | | | | |
|---|---|---|---|---|
| 2008/0273708 | A1* | 11/2008 | Sandgren | G10K 15/08 381/63 |
| 2010/0302015 | A1* | 12/2010 | Kipman et al. | 340/407.1 |
| 2013/0121515 | A1 | 5/2013 | Hooley et al. | |
| 2013/0129103 | A1 | 5/2013 | Donaldson | |
| 2013/0322674 | A1* | 12/2013 | Ren et al. | 381/337 |

OTHER PUBLICATIONS

"Experience Truly Immersive Audio-Spatial Audio Technology", Published on: Nov. 25, 2011, Retrieved at: <<http://www.ti.com/ww/en/analog/spatial_audio/files/spatial_audio_brochure.pdf>>, Retrieval Date: Aug. 27, 2013, 6 pages.

Lee, et al., "Unified Framework for User Tracking and Sound Beamforming with Audio/Depth Sensors in Kinect", In Pervasive Computing—10th International Conference, Jun. 18, 2012, 4 pages.

Song, et al., "An Interactive 3D Audio System with Loudspeakers", In IEEE Transactions on Multimedia, vol. 13, Issue 5, Oct. 2011, 11 pages.

Guldenschuh, et al., "Transaural Stereo in a Beamforming Approach", In Proceeding of the 12th International Conference on Digital Audio Effect, Sep. 1, 2009, 6 pages.

Choueiri, Edgar Y., "Optimal Crosstalk Cancellation for Binaural Audio with Two Loudspeakers", Published on: Dec. 2010, Retrieved at: <<http://www.princeton.edu/3D3A/Publications/BACCHPaperV4d.pdf>>, Retrieval Date: Aug. 26, 2013, 24 pages.

"International Search Report (ISR) and Written Opinion for PCT Application No. PCT/US2015/011074", Mailed Date: May 20, 2015, 12 Pages.

International Preliminary Report on Patentability for PCT Application No. PCT/US2015/011074, Mailed Date: Feb. 16, 2016, 8 Pages.

"Written Opinion of the International Preliminary Examining Authority for PCT Application No. PCT/US2015/011074", Mailed Date: Oct. 2, 2015, 7 Pages.

"Response to the International Search Report (ISR) and Written Opinion for PCT Application No. PCT/US2015/011074", Filed Date: Sep. 3, 2015, 11 Pages.

"Response to the Office Action for European Patent Application No. 15707825.4", Filed Date: Oct. 3, 2016, 13 Pages.

* cited by examiner

ENHANCED SPATIAL IMPRESSION FOR HOME AUDIO

BACKGROUND

The living room of the home accounts for a large portion of audiovisual experiences consumed by people, such as games, movies, music, and the like. While there has been a significant focus on visual displays for the home, such as high-resolution screens, large screens, projected surfaces, etc., there is significant unexplored territory in auditory display. Specifically, in all of the media mentioned above, a designer of the audio creates the content with a specific aural experience in mind. Acoustic conditions and speaker set up in a typical living room, however, are far from ideal. That is, the room modifies the intended acoustics of the audio content with its own acoustics, which can significantly reduce immersion of the soundscape, as unintended (and unforeseen) acoustics are mixed with the original intent of a designer of the audio. This unwanted modification depends on the placement of speakers, geometry of the room, room furnishings, wall materials, etc. For example, an auditory designer may wish for a listener to feel as if they are located in a large forest. Due to the point-source nature of conventional speakers, however, the listener typically perceives that forest noises are coming from a speaker. Thus, a large forest in a movie sounds as if it is located inside the living room, rather than the listener having the aural experience of being positioned in the middle of a large forest.

Generally, acoustics of a space can be mathematically captured by the so-called impulse response, which is a temporal signal received at a listener point when an impulse is played at a source point in space. A binaural impulse response is the set of impulse responses at the entrance of two ear canals, one for each ear of the listener. The impulse response comprises three distinct phases as time progresses: 1) an initially received direct sound; followed by 2) distinct early reflections; followed by 3) diffuse late reverberation. While the direct sound provides strong directivity cues to a listener, it is the interplay of early reflections and late reverberation that give humans a sense of aural space and size. The early reflections are typically characterized by a relatively small number of strong peaks superposed on a diffuse background comprising numerous low-energy peaks. A ratio of diffuse energy increases over the course of the early reflections until there is only diffuse energy, which marks the beginning of late reverberation. Late reverberation can be modeled as Gaussian noise with a temporally decaying energy envelope.

For convincing late reverberation, the Gaussian noise in the late reverberation is desirably uncorrelated between two ears of the listener. With conventional speaker setups, however, even if late reverberation emanating from speakers is mutually uncorrelated, the binaural response for any given speaker is correlated between the two ears, as both ears received the same sound from the speaker (apart from acoustic filtering by the head and shoulders). As this occurs for all speakers in the room, a net effect is a muddled auditory image somewhere between the original intended auditory image versus a small space restricted inside the speakers or within a room.

A technique referred to as crosstalk cancellation has been utilized to address some of the shortcomings associated with conventional audio systems. Generally, crosstalk cancellation has been used to allow binaural recordings (those made with microphones in the ears and intended for headphones) to play back over speakers. Crosstalk cancellation methods receive a portion of a signal to be played over a left speaker and feed such portion to the right speaker with a particular delay (and phase), such that it combines with the actual right speaker signal and thus cancels the portion of the audio signal that goes to the left ear. Conventional systems, however, restrict the position of the listener to a relatively small space. If the listener changes position, artifacts are generated, negatively impacting the experience of the listener with respect to presented audio.

SUMMARY

The following is a brief summary of subject matter that is described in greater detail herein. This summary is not intended to be limiting as to the scope of the claims.

Described herein are various technologies pertaining to improving listener experience with respect to audio emitted to such listener, such that the listener is provided with a more immersive experience. As will be described in greater detail herein, a combination of beamforming, crosstalk cancellation, and location and orientation tracking can be utilized to provide the listener with an immersive aural experience. An audio system includes at least two beamforming transducers, referred to herein as a "left beamforming transducer" and a "right beamforming transducer." Each beamforming transducer may comprises a respective plurality of speakers. The beamforming transducers can be configured to directionally transmit audio beams, wherein an audio beam emitted from a beamforming transducer can have a controlled diameter (e.g., at least for relatively high frequencies). Thus, for example, a beamforming transducer can direct an audio beam towards a particular location in three-dimensional space.

In an exemplary embodiment, a sensor can be configured to monitor a region relative to the left and right beamforming transducers. For example, the left and right beamforming transducers can be positioned in a living room, and the sensor can be configured to monitor the living room for humans (listeners). The sensor is configured to identify the existence of listeners in the region and further identify locations of respective listeners in the region (relative to the left and right beamforming transducers). With more particularity, the sensor can be configured to identify the locations and orientations of heads of the respective listeners in the region monitored by the sensor. Accordingly, the sensor can be utilized to identify the three-dimensional position of heads of listeners in the region of interest and orientation of such heads. In another exemplary embodiment, the sensor can be utilized to identify locations and orientations of ears of listeners in the region of interest.

A computing apparatus, such as a set top box, game console, television, audio receiver, or the like, may receive or compute a left audio signal that is desirably heard by left ears (and only left ears) of listeners in the region and a right audio signal that is desirably heard by right ears (and only right ears) of the listeners in the region. Based upon locations and orientations of heads of listeners in the region, the computing apparatus can create respective customized left and right audio signals for each listener. Specifically, in an exemplary embodiment, for each listener identified in the region, the computing apparatus can modify their respective left and right audio signals utilizing a suitable crosstalk cancellation algorithm. More specifically, since the location and orientation of a head of a first listener in the region is known, the computing apparatus can utilize a suitable crosstalk cancellation algorithm to modify a left audio signal and a right audio signal for the first listener, thereby generating respective modified left and right audio signals for the first listener. This process can be repeated for a second listener (and other listeners). For example, as the location and orientation of the head of the second listener is known (based upon output of the sensor), the computing apparatus can utilize the crosstalk cancellation algorithm to modify a left audio signal and a right audio signal for the second listener, thus creating modified left and right audio signals for the second listener.

The computing apparatus can transmit the modified left audio signal for the first user, as well as location of the head of the first user, to the left beamforming transducer. The computing apparatus can additionally transmit the modified right audio signal for the first listener to the right beamforming transducer together with location of the head of first listener. The left beamforming transducer directionally transmits a left audio beam to the first listener based upon the modified left audio signal for the first listener and the location of the head of the first listener. Likewise, the right beamforming transducer directionally transmits a right audio beam to the first listener based upon the modified right audio signal for the first listener and the location of the head of the first listener. The process can also be performed for the second listener, such that the second listener is provided with left and right audio beams from the left and right beamforming transducers, respectively. As crosstalk cancellation is performed for each listener (based upon the location and orientation of heads of the respective listeners), and each listener is provided with directional (constrained) audio beams, the first and second listeners can have the perception of wearing headphones, such that audio is uncorrelated at the ears of the listeners, providing each listener with a more immersive aural experience.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
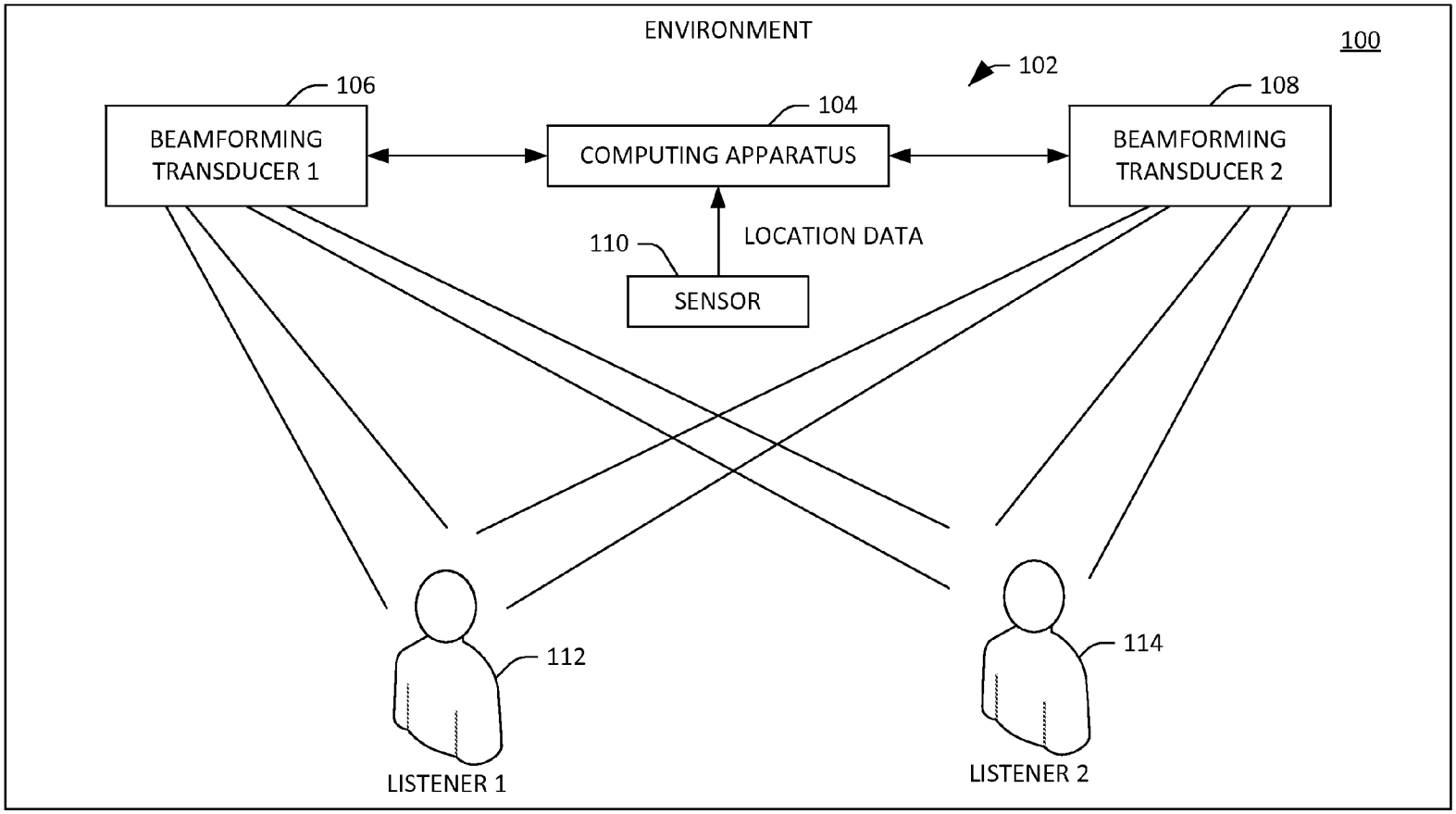
FIG. 1 illustrates a system that is configured to employ a combination of crosstalk cancellation and beamforming to reduce late reverberation experienced by listeners in an environment.

Various technologies pertaining to improving aural experience of listeners in an environment are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by a single system component may be performed by multiple components. Similarly, for instance, a single component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Further, as used herein, the terms "component" and "system" are intended to encompass computer-readable data storage that is configured with computer-executable instructions that cause certain functionality to be performed when executed by a processor. The computer-executable instructions may include a routine, a function, or the like. Additionally, the terms "component" and "system" are intended to encompass circuitry that is configured to perform certain functionality (e.g., application-specific integrated circuits, field programmable gate arrays, etc.). It is also to be understood that a component or system may be localized on a single device or distributed across several devices. Further, as used herein, the term "exemplary" is intended to mean serving as an illustration or example of something, and is not intended to indicate a preference.

With reference now to FIG. 1, an environment 100 that includes an audio system 102 is illustrated. While the environment 100 is described herein as being a living room, it is to be understood that the environment 100 may also be an interior of an automobile, a movie theater, an outdoor venue, or the like. The audio system 102 includes a computing apparatus 104, which can be or include any computing apparatus that comprises suitable electronics for processing audio signals. For example, the computing apparatus 102 may be an audio receiver device, a set top box, a game console, a television, a conventional computing apparatus, a mobile telephone, a tablet computing device, a phablet computing device, a wearable, or the like. A first beamforming transducer 106 and a second beamforming transducer 108 are in communication with the computing apparatus 104. The first beamforming transducer 106 may be referred to as a "left beamforming transducer", while the second beamforming transducer 108 may be referred to as a "right beamforming transducer". While the computing apparatus 104 is shown to be in communication with only the two beamforming transducers 106 and 108, it is to be understood that in other embodiments, the environment 100 may include more beamforming transducers that are in communication with the computing apparatus 104. The term "beamforming transducer" refers to an electroacoustic transducer that can generate highly directional acoustic fields, and can further generate a superposition of multiple such fields propagating in different directions, each carrying a corresponding sound signal.

In an exemplary embodiment, each of the beamforming transducers 106 and 108 includes a respective plurality of speakers that are configured with digital signal processing (DSP) functionality that facilitates the above-mentioned generation of directional acoustic fields. In an exemplary embodiment, each beamforming transducer can have a length of less than one meter, and can comprise a plurality of speakers positioned as close to one another as possible. In another exemplary embodiment, the beamforming transducers 106 and 108 can use acoustic signals as carrier waves, and can have a length of approximately one foot.

Thus, for example, the first beamforming transducer 106 can output a plurality of directional audio beams to a respective plurality of locations in the environment 100. Similarly, the second beamforming transducer 108 can output a plurality of directional audio beams to a respective plurality of locations in the environment 100. The audio system 102 may also include a sensor 110 that is configured to output data that is indicative of locations and orientations of heads of listeners that are in the environment 100. With more particularity, the sensor 110 can be configured to output data that is indicative of three-dimensional locations of respective ears of listeners in the environment 100. Thus, for example, the sensor 110 may be or include a camera, stereoscopic cameras, a depth sensor, etc. In another exemplary embodiment, listeners in the environment 100 may have wearable computing devices thereon, such as glasses, jewelry, etc., that can indicate a location of their respective heads (and/or ears) in the environment 100.

In FIG. 1, the environment 100 is shown as including a first listener 112 and a second listener 114 who are listening to audio output by the beamforming transducers 106 and 108. It is to be understood, however, that aspects described herein are not limited to there being two listeners. For instance, the environment 100 may include a single listener or three or more listeners.

In an example, the sensor 110 can capture data pertaining to the environment 100 and can output data that is indicative of locations of the ears (and head rotations) of the first listener 112 and second listener 114, respectively. The computing apparatus 104 can receive an audio descriptor, wherein the audio descriptor is representative of audio that is to be presented to the listeners 112 and 114. The audio descriptor can include a left audio signal that represents audio desirably output by the first beamforming transducer 106 and a right audio signal that represents audio desirably output by the second beamforming transducer 108.

As described herein, the audio system 102 can be configured to provide both the first listener 112 and the second listener 114 with a more immersive audio experience when compared to conventional audio systems. The sensor 110, as noted above, is configured to scan the environment 100 for listeners therein. In the example shown in FIG. 1, the sensor 110 can output data that indicates that the environment 100 includes two listeners; the first listener 112 and the second listener 114. The sensor 110 can also output data that is indicative of locations and orientations of the heads of the first listener 112 and the second listener 114, respectively. Still further, the sensor 110 may have suitable resolution to output data that can be analyzed to identify precise locations of ears of the first listener 112 and the second listener 114 in the environment 100. In another example, poses of respective heads of the listeners 112 and 114 can be identified, and locations of ears of the listeners 112 and 114 can be estimated based upon the head poses. The data output by the sensor 110 may be depth data, video data, stereoscopic image data, or the like. It is to be understood that any suitable localization technique can be employed to detect locations and orientations of the heads (and/or ears) of the listeners 112 and 114, respectively.

The computing apparatus 104 processes an (stereo) audio signal that is representative of audio to be provided to the first listener 112 and the second listener 114, wherein such processing can be based upon the computing apparatus 104 determining that the environment 100 includes the two listeners. The computing apparatus can additionally (dynamically) process the audio signal based upon the locations and orientations of the heads of the first listener 112 and the second listener 114, respectively. As indicated above, the audio signal comprises a left audio signal and a right audio signal, which may be non-identical. Responsive to detecting that the environment 100 includes the two listeners 112 and 114, the computing apparatus 104 can generate left and right audio signals for each of the listeners 112 and 114, respectively. With more specificity, the computing apparatus 104 can create a left audio signal and a right audio signal for the first listener 112, and a left audio signal and a right audio signal for the second listener 114. The computing apparatus 104 may then process the left and right audio signals for each of the listeners 112 and 114, respectively, based upon the respective locations and orientations of their heads in the environment 100.

With respect to the first listener 112, the computing apparatus 104 can dynamically modify the left audio signal and the right audio signal for the first listener 112 using a suitable crosstalk cancellation algorithm, wherein such modification is based upon the location and orientation of the head of the first listener 112. The crosstalk cancellation algorithm is configured to reduce crosstalk caused by late reverberations from a single sound source reaching both ears of the first listener 112. Generally, it may be desirable for the left ear of the first listener 112 (when facing the audio system 102) to hear audio output by a speaker to the left of the first listener 112 without hearing audio output by a speaker to the right of the first listener 112. Likewise, it may be desirable for the right ear of the listener 112 to hear audio output by the speaker to the right of the listener 112 without hearing audio output by the speaker to the left of the listener. Utilizing a suitable crosstalk cancellation algorithm, the computing apparatus 104 can modify the left audio signal and the right audio signal for the first listener 112 based upon the location and orientation of the head (ears) of the first listener 112 in the environment 100 (presuming the location of the first beamforming transducer 106 and the second beamforming transducer 108 are known and fixed). Such modified left and right audio signals can be provided to the first beamforming transducer 106 and the second beamforming transducer 108, respectively, together with data that identifies the location of the head of the first listener 112 in the environment 100.

As noted above, the first beamforming transducer 106 and the second beamforming transducer 108 include respective pluralities of speakers. Therefore, the first beamforming transducer 106 can receive the modified left audio signal for the first listener 112, as well as a location of the head of the first listener 112 in the environment 100. Responsive to receiving the modified left audio signal and the location of the head of the first listener 112 (relative to the first beamforming transducer 106), the first beamforming transducer 106 can emit an audio stream directionally (and with a constrained diameter) to the first listener 112. Likewise, the second beamforming transducer 108 can receive the modified right audio signal for the first listener 112, as well as the location of the head of the first listener 112 in the environment 100 (relative to the second beamforming transducer 108). Responsive to receiving the right modified audio signal and the location of the head of the first listener 112, the second beamforming transducer 108 can emit an audio stream directionally (and with a constrained diameter) to the first listener 112. Beamforming, in such manner, can effectively create an audio "bubble" around the head of the listener 112, such that the first listener 112 perceives an experience of wearing headphones, without actually having to wear headphones.

The computing apparatus 104 can (simultaneously) perform similar operations for the second listener 114. Specifically, the computing apparatus 104, based upon the location of the head (ears) of the second listener 114 in the environment 100, can modify the left and right audio signals for the second listener 114 utilizing the crosstalk cancellation algorithm. The computing apparatus 104 transmits the modified left and right audio signals for the second listener 114 to the first beamforming transducer 106 and the second beamforming transducer 108, respectively. Again, this can create an audio "bubble" around the head of the second listener 114, such that the second listener 114 perceives an experience of wearing headphones, without actually having to wear headphones. Accordingly, the first listener 112 and the second listener 114 can both have the aural experience of wearing headphones, without social awkwardness that may be associated therewith.

In summary, then, the computing apparatus 104 can receive a stereo signal that comprises a left signal ($S_L$) and a right signal ($S_R$). Based upon the signal output by the sensor 110, the computing apparatus 104 can compute the view direction and head position of the first listener 112. Then, based upon the view direction and head position of the first listener 112, the computing apparatus 104 can utilize a crosstalk cancellation algorithm to determine signals to be output by the beamforming transducers 106 and 108. For example, the computing apparatus 104 can apply a linear filter on $S_L$ and a linear filter on $S_R$ for the first listener, resulting in the forming of $S_{L1}$ and $S_{R1}$. $S_{L1}$ and $S_{R1}$ are transmitted to the first and second beamforming transducers 106 and 108, respectively, as well as information as to the direction of audio beams to be output by such transducers. The beamforming transducers 106 and 108 then directionally emit $S_{L1}$ and $S_{R1}$, respectively, to the first listener 112. This process can be performed simultaneously for the second listener 114 (and other listeners who may be in the environment 100).

In another example, the system 100 can be configured to provide the listeners 112 and 114 with respective customized three-dimensional audio experiences. For instance, if a plate were broken immediately to the left of the first listener 112, the sound caused by the breaking of the plate will be perceived differently by the listeners 112 and 114. That is, the first listener 112 can, based upon the sound of the plate breaking, ascertain that the breaking of the plate occurred in close proximity to the first listener, while the second listener 114 can ascertain that the plate has broken further away. The computing apparatus 104 can be configured to process an audio signal such that the listeners 112 and 114 have different spatial experiences with the audio as a function of the locations of the listeners 112 and 114 in the environment 100. Thus, the computing apparatus 104 can process an audio signal to cause a first left audio signal and a first right audio signal to be transmitted to the first beamforming transducer 106 and the second beamforming transducer 108, respectively, based upon the head location and orientation of the first listener 112. Beamforming speakers in the beamforming transducers 106 and 108 can emit respective audio beams that provide a customized spatial experience for the first listener 112 (e.g., to cause the sound of a plate breaking to seem close to the first listener 112). Simultaneously, the computing apparatus 104 can process the audio signal to cause a second left audio signal and a second right audio signal to be transmitted to the first beamforming transducer 106 and the second beamforming transducer 108, respectively, based upon the head location and orientation of the second listener 114. To provide the customized spatial experiences, the computing apparatus 104 can compute respective sets of linear filters for the listeners 112 and 114, where a first set of linear filters computed by the computing apparatus 104 for the first listener 112 is configured to provide the first listener 112 with a first customized spatial experience (as a function of location of the head and orientation of the head of the first listener 112), while a second set of linear filters is configured to provide the second listener 114 with a second customized spatial experience (as a function if location of the head and orientation of the head of the second listener 114). The beamforming transducer 106 and 108 can emit respective audio beams that provide a customized spatial experience for the second listener 114 (e.g., to cause the sound of the plate breaking to seem further from the second listener 114).

While the environment 100 has been shown and described as including the first listener 112 and the second listener 114, it is to be understood that the functionality described above can be performed when a single listener is in the environment 100 or when more than two listeners are in the environment 100. Further, (as referenced above) additionally or alternatively to performing the beamforming and crosstalk cancellation functionality, the computing apparatus 104 can perform audio processing to provide one or more listeners (e.g., the listeners 112 and 114) with personalized perceptual effects. For example, the computing apparatus 104 can determine a location of the first listener 112 and can process an audio signal to generate certain early reflections, thereby synthesizing a particular spatial aural experience for the first listener 112. Thus, the computing apparatus 104 can process the audio signal to cause the first listener 112 to perceive (aurally) that the first listener 112 is at a particular location in a cathedral, in a large conference room, in a lecture hall, etc. Similarly, the computing apparatus 104 can process the audio signal to cause the first listener 112 to perceive a particular reverberation time and reverberation amplitudes, which are different from the natural reverberation times and amplitudes of the environment 100. Again, through use of the beamforming transducers and location tracking, personalized spatial effects can be provided simultaneously to multiple listeners in the environment 100. Further, it is to be understood that the computing apparatus 104 can dynamically perform the processing described above based upon determined locations and orientations of heads of the listeners 112-114. Therefore, as the listeners 112 and 114 move about in the environment 100, the computing apparatus 104 can dynamically process the audio signal to perform crosstalk cancellation and/or provide personalized perceptual effects.

Various exemplary details pertaining to spatial effects that are enabled through use of the audio system 102 are now set forth. The audio system 102 can cause each ear of each listener in the environment 100 to receive an audio signal with at least a 20 dB signal/noise ratio. The audio media that is to be presented to listeners can be encoded such that the media includes information about direction and sound to be received at an ear from that direction, over a multitude of spherical directions (e.g., separated by a few degrees). Additionally, the audio media need not have the acoustics of the scene applied on the sound source already, but can instead include acoustic filters separately from the sounds. Accordingly, the audio system 102 can perform a wide variety of manipulations to provide customized spatial audio perceptions to listeners in the environment 100. This can be accomplished various signal processing steps, which can include the following: 1) based on application-specific needs for manipulating spatial sense, which can take into consideration real head position, orientation, (optionally) user input, or other application-specific needs, the computing apparatus 104 can compute and/or modify binaural acoustic filters for each individual listener, where the acoustic filters capture a spatial experience for a particular listener. It is to be understood that the filters can alter dynamically as head position of the particular listener alters. Additionally, the computing apparatus 104 can receive information pertaining to audio perceived by the listeners (e.g., captured by microphones of mobile computing devices of the listeners), and can compute and/or modify the acoustic filters as a function of actual sound captured in proximity to the listeners. 2) The computing apparatus 104 can receive recorded and/or generated audio information for output into the environment 100, and, for each listener in the environment, convolve such information with the appropriate filters to create a customized binaural signal for each listener. 3) The audio system 102 delivers binaural signals to the listeners in the environment 100.

It can therefore be noted that different spatial effects can be provided to different listeners in the environment 100, where the source sound is common. Unwanted signals that reach ears of listeners in the environment 100, such as those from room reflections, beams overlapping, or less than perfect beamforming, include the same source sound signal, even if spatialized differently; accordingly, these unwanted signals may cause some muddling in the spatialization effects (such as the perception of a virtual sound source as having two locations), which is less confusing than hearing an entirely different sound superimposed on intended audio.

Exemplary personalized spatial effects that can be accomplished by the audio system 102 are now set forth. In a first exemplary spatial effect, personalized modification can be made to audio to provide a subjective audio experience. The computing apparatus 104 can be configured (for a particular listener) to compute late reverberation filters through which all audio to be emitted into the environment 100 by the audio system 102 is filtered. The audio system 102 can thus deliver relatively high-quality immersive late reverberation, where the immersion is achieved due to de-correlation between left and right signals (as the brain is known to interpret that as wave-fronts coming from multiple random directions). By manipulating the early decay time, diffusion, and delay between direct and reflected sounds in the early reflections, the intimacy and warmth of the acoustics can be controlled. The late reverberation filters, for instance, can be computed based upon user input, where each listener in the environment 100 can specify a percentage modification on acoustic parameters to modify the experience to their individual tastes. For instance, the first listener 112 and the second listener 114 may be enjoying the same music, movie, or media simultaneously in the environment 100, and may choose different acoustics (e.g., one preferring a warm, studio-like sound, while the other prefers a concert hall sound). Additionally, the listeners 112 and 114 can cause the computing device 104 to retain listening preferences, and the signal output by the sensor 110 can be analyzed to identify the listeners 112 and 114, and their respective audio preferences can be used to provide customized aural experiences for the listeners. Moreover, a library of listening environments is contemplated, where each listener can select a desired listening environment. Continuing with this example, the first listener 112 can indicate that she wishes to experience audio as if she were at an outdoor concert venue, while the second listener 114 can indicate that she wishes to experience the audio as if she were at a movie theater. An exemplary library can include multiple potential locations, such as "cathedral", "outdoor concert venue", "stadium", "open field", "conference room", and so forth. The library may also allow listeners to specify relatively precise locations in a particular environment—e.g., "balcony of a theater." The listeners 112 and 114 may also specify values for binaural filters, such that multiple listeners in an environment can be provided with their own customized spatial experience.

In a second exemplary spatial effect, auditory experiences can be experienced both individually and shared with another person (simultaneously). In an exemplary application, one may wish to convey a common space within which everyone is immersed, but at the same time provide individualized acoustics for certain aspects of a virtual sound field. The audio system 102 can be configured to enable such applications, as the computing apparatus 104 can generate a common late reverberation binaural signal (common to all listeners in the environment) and individualized direct and/or reflected binaural signals (such that each listener receives respective customized direct binaural signals and respective customized reflected binaural signals). The perception of shared space is based upon the observation that the late reverberation is largely a function of the global environment, while the direct and early reflection components are dependent on location in the global environment (e.g., a scene of the global environment). Conventional approaches, such as headphones, cause auditory occlusion of real sounds, thus creating an isolated experience. Conventional surround sound systems can be used to create a shared experience, but are not capable of producing individualized acoustics.

In an example, friends may be sitting in a living room playing a first-person 3-D computer game in split-screen mode. Each person amongst the friends may be located in the same virtual space (e.g., an urban street canyon), cooperating against enemies in the computer game. For this scenario, the computing apparatus 104 of the audio system 102 can generate a common binaural signal that is to be presented to all of the persons in the living room, where the common binaural signal is configured to synthesize the late reverberation in the shared virtual space. The common binaural signal is provided to all of the listeners in the environment, such that the listeners are provided with the experience of being immersed in the same space. At the same time, the computing apparatus 104 can generate appropriately spatialized direct and reflected binaural sound signals individually for the players (depending on their position and orientation with respect to the virtual space), thus simultaneously providing them with individualized spatial source location and filter cues that may differ between them to convey their respective states in the game. For example, in the game, a first player may be ducking behind an obstacle, while a second player is standing in the open. The audio system 102 can be configured to provide a muffled direct sound to the first player compared to the sound directed to the second player.

Figure 2:
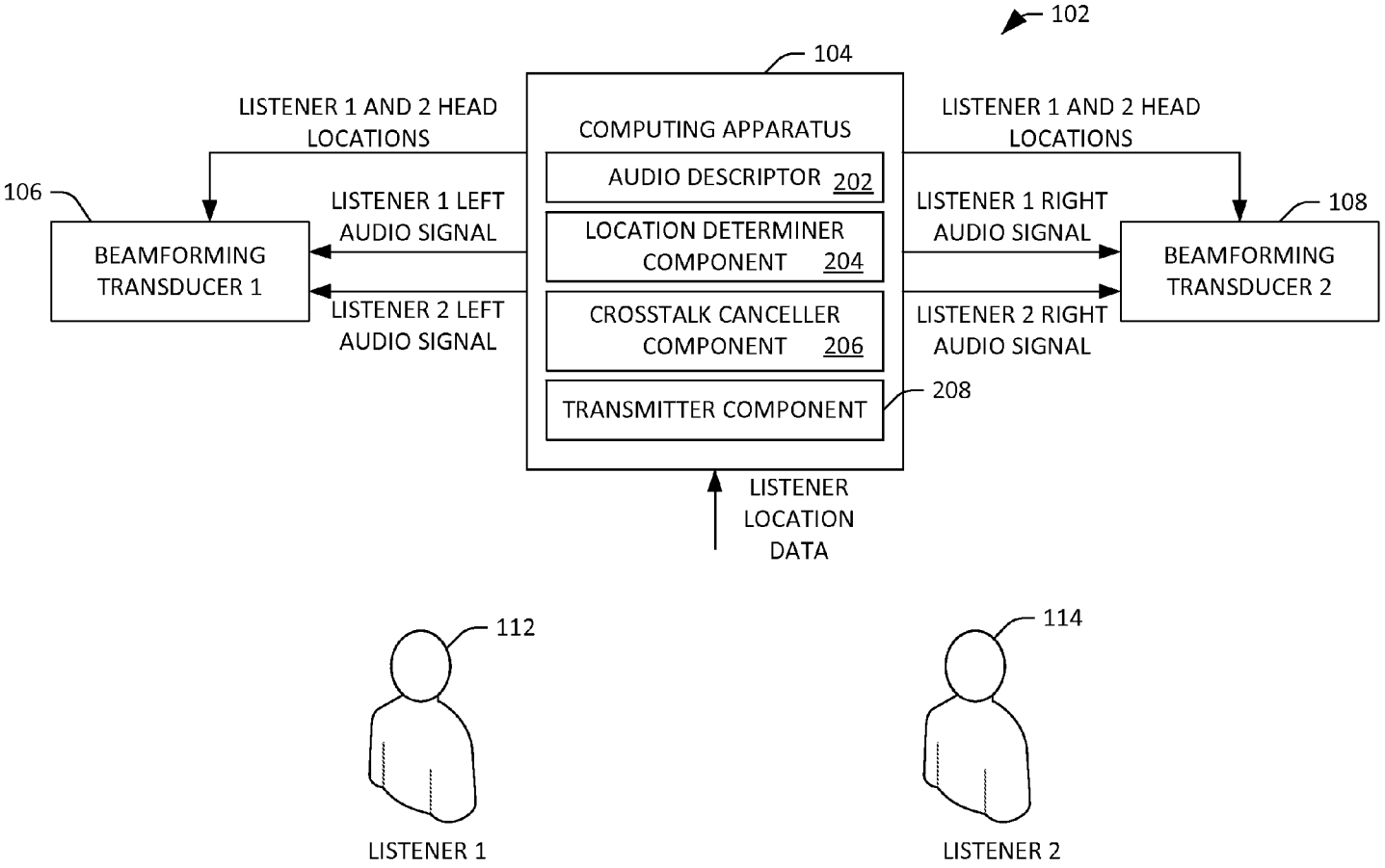
FIG. 2 illustrates an exemplary system for providing audio beams to two different listeners at two different locations in an environment.

Now referring to FIG. 2, a functional block diagram of the audio system 102 is illustrated. The audio system 102 includes the computing apparatus 104, which has an audio descriptor 202 being processed thereby. The computing apparatus 104 may include a processor, an Application Specific Integrated Circuit (ASIC), a Field Programmable Gate Array (FPGA), a System on a Chip system (SoC), or other suitable electronic circuitry for processing the audio descriptor 202. In an exemplary embodiment, the audio descriptor 202 can be or be a portion of an audio file retained in memory of the computing apparatus 104. Such audio file may be an MP3 file, a WAV file, or other suitably formatted file. In another example, the audio descriptor 202 can be a portion of an audio broadcast, a portion of dynamically generated video game audio, a portion of an audio stream received from a service that provides audio/video, etc.

The computing apparatus 104 additionally includes a location determiner component 204 that is configured to receive data from a sensor and ascertain existence of one or more listeners in an environment and their respective head locations and orientations in the environment. For instance, the sensor 110 may include a video camera that outputs images of the environment. The location determiner component 204 can utilize face recognition technologies to ascertain existence of listeners in the environment. Responsive to the location determiner component 204 detecting existence and location of the listener, a crosstalk canceller component 206 can, based upon the location of the head and the orientation of the head of the listener in the environment, modify the audio signal 202 such that an audio signal output by the first beamforming transducer 106 is de-correlated between the ears of the listener and the audio output by the second beamforming transducer 108 is de-correlated between the ears of the listener. A transmitter component 208 transmits modified left and right audio signals to the first and second beamforming transducers 106 and 108, respectively. The left audio signal includes a portion that is configured to cancel audio output by the second beamforming transducer 108 that is calculated to reach the left ear of the listener. Likewise, the right audio signal includes a portion that is configured to cancel audio output by the first beamforming transducer 106 that is calculated to reach the right ear of the listener. Effectively then, the listener can experience audio as if she is wearing headphones Use of beamforming together with crosstalk cancellation (and location and orientation tracking) allows for two or more listeners to simultaneously have an immersive aural experience in an environment. As shown, the environment can include the first listener 112 and the second listener 114. The location determiner component 204 can receive data that is indicative of locations and orientations of heads (ears) of the listeners 112 and 114 from the sensor 110, and can determine the locations and orientations of the heads of the first listener 112 and the second listener 114, respectively. The crosstalk canceller component 206 can cause a copy of the audio signal 202 to be generated and retained in memory, such that the memory includes a first audio signal for the first listener 112 and a second audio signal for the second listener 114. As described above, the first audio signal for the first listener 112 includes left and right audio signals for the first listener 112 that are to be transmitted to the first beamforming transducer 106 and the second beamforming transducer 108, respectively. The crosstalk canceller component 206 can modify the left and right audio signals for the first listener 112 utilizing a suitable crosstalk cancellation technique based upon the identified location of the head (ears) of the first listener 112. Likewise, the second audio signal comprises left and right audio signals to be transmitted to the first and second beamforming transducers 106 and 108, respectively. The crosstalk canceller component 206 can utilize the crosstalk cancellation technique to modify the left and right audio signals for the second listener 114 based upon the location and orientation of the head of the second listener 114.

The transmitter component 104 can transmit, to the first beamforming transducer 106, the left audio signal for the first listener 112 and the left audio signal for the second listener 114, together with the location of the head of the first listener 112 and the location of the head of the second listener 114. The transmitter component 104 also transmits the right audio signal for the first listener 112 and the right audio signal for the second listener 114, together with locations of the heads of the first listener 112 and the second listener 114, respectively, to the second beamforming transducer 108. As noted above, the first beamforming transducer 106 and the second beamforming transducer 108 may include multiple speakers, such that the first and second beamforming transducers 106 and 108 transmit individualized (space-constrained) sound streams to each of the first listener 112 and the second listener 114.

The first beamforming transducer 106 and the second beamforming transducer 108 can utilize any suitable beamforming techniques. For instance, each beamforming transducer can comprise multiple speakers having directional radiation patterns that vary between speakers in the arrays. In another exemplary embodiment, the beamforming transducers 106 and 108 can direct audio beams to listeners through utilization of ultrasonic carrier waves, wherein ears of listeners automatically de-modulate a signal that has been modulated by way of an ultrasonic carrier wave. Frequencies in an audio beam can include frequencies above, for instance, 500 Hz, which includes most late reverberations. For lower frequencies in the audio beams output by the beamforming transducers 106 and 108, directionality is not as crucial, as late reverberation is not associated with such lower frequencies. For such lower frequencies, the computing apparatus 104 can equalize the output (based upon computed or estimated frequency responses) to counteract unwanted room resonance modes.

Further, utilizing beamforming can reduce reflections from flat wall areas in the environment 100, which are a major component of unwanted room acoustics. Thus, a relatively tight beam of sound can automatically reduce severity of such unwanted reflections that arrive at a listener. This is because, for a beam oriented directly at a listener, there are a limited number of high order specular reflection paths that end at the listener. This number is far less than a number of specular arrivals from an omnidirectional source. Additionally, the beam will scatter considerably from the head and body of the listener immediately upon arrival. Accordingly, it can be ascertained that as an audio beam becomes more focused, the issues associated with unwanted specular reflections are reduced. Still further, total audible acoustic power of a beamformer can be reduced in a beamforming system compared to a surround sound system for achieving a same loudness at a listener, as beamforming systems fail to emit much audible acoustic energy in a region outside of the beam. Thus, unwanted audible acoustic power that diffuses and reflects around the environment 100 is smaller compared to a conventional surround sound system.

Moreover, while the first beamforming transducer 106 and the beamforming transducer 108 have been described as receiving locations pertaining to the first listener 112 and second listener 114, respectively, in other exemplary embodiments, the computing apparatus 104 can be configured to compute directionality of audio beams internally, and transmit instructions to the beamforming transducers 106 and 108 based upon such computations. For example, the computing apparatus 104 can have knowledge of the locations of the beamforming transducers 106 and 108 in the environment 100, and can compute a direction from the beamforming transducers 106 and 108 to the first listener 112 and the second listener 114, respectively. The computing apparatus 104 may thus provide the first beamforming transducer 106 with two angular coordinates from a reference point in the beamforming transducer 106 (e.g., from a center of the beamforming transducer 106, from a particular speaker in the beamforming transducer 106, etc.). Similarly, the computing apparatus 104 can provide a pair of angular coordinates that identify locations of the first listener 112 and second listener 114 relative to a reference point on the beamforming transducer 108. The first and second beamforming transducers 106 and 108 can each emit a pair of audio beams in accordance with the angular directions provided by the computing apparatus 104.

Figure 3:
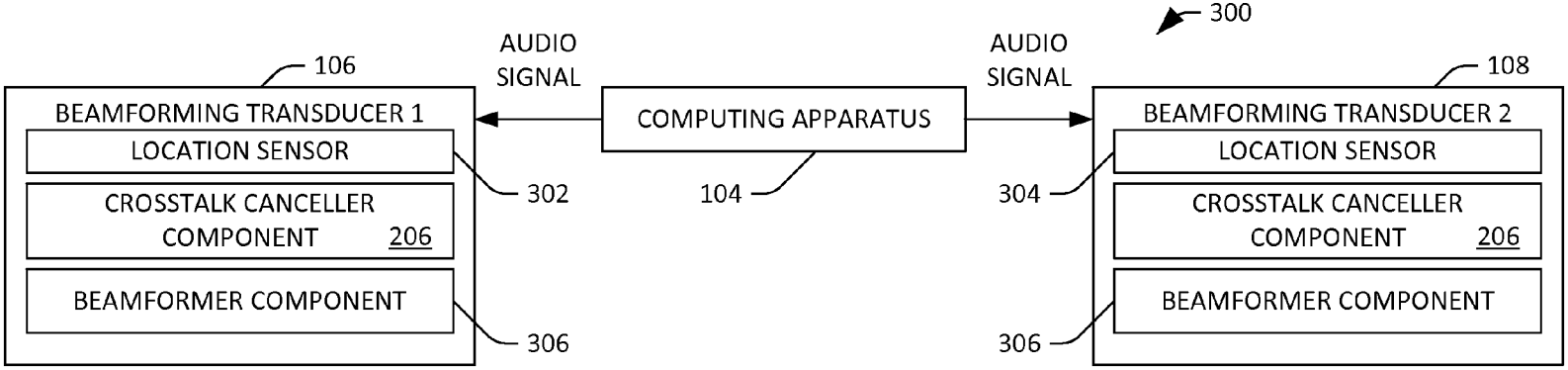
FIG. 3 illustrates an exemplary set of beamforming transducers that are configured to process and output audio to at least one listener based upon a location of the listener in an environment.

Now referring to FIG. 3, an exemplary audio system 300 is illustrated. In the exemplary audio system 300, the individual beamforming transducers 106 and 108 are configured to perform operations described previously as being performed by the computing apparatus 104. For example, the first and second beamforming transducers 106 and 108 can include first and second location sensors 302 and 304, respectively, which are configured to scan an environment that includes the audio system 300 for listeners therein. Further, the first and second beamforming transducers 106 and 108 can each include a respective instance of the location determiner component 204, which can determine locations and orientations of heads of listeners relative to the locations of the beamforming transducers 106 and 108 based upon data output by the location sensors 302 and 304. In another exemplary embodiment, rather than both the beamforming transducers 106 and 108 including a location sensor, only one of such arrays may include a location sensor and corresponding location determiner component, and can transmit locations and orientations of heads of listeners to the other beamforming transducer. For instance, the first beamforming transducer 106 can include the location sensor 302 and can transmit locations and orientations of heads of listeners in the environment to the second beamforming transducer 108. In yet another exemplary embodiment, a location sensor can be external to both beamforming transducers 106 and 108, and the computing apparatus 104 can provide locations and orientations of heads of listeners in the environment to the first and second beamforming transducers 106 and 108.

In the exemplary audio system 300, the beamforming transducers 106 and 108 each include a respective instance of the crosstalk canceller component 306. For instance, the first beamforming transducer 106 can receive the audio signal from the computing apparatus 104, which includes a left and right audio signal. The crosstalk canceller component 306, in either or both of the beamforming transducers 106 and 108, can utilize a crosstalk cancellation algorithm to modify the left and right audio signals respectively. If both beamforming transducers 106 and 108 include the crosstalk canceller component 206, the first beamforming transducer 106 can modify only a left audio signal(s) and the second beamforming transducer 108 can modify only a right audio signal(s). In another exemplary embodiment, rather than both beamforming transducers 106 and 108 including the crosstalk canceller component 206, one of such beamforming transducers can include the crosstalk canceller component 206 and can provide the other of the beamforming transducers with its appropriate audio signals.

Each of the first beamforming transducer 106 and the second beamforming transducer 108 includes an instance of a beamformer component 306, which is configured to calculate directions and spatial constraints of audio beams based upon locations of heads of listeners in the environment. The beamformer component 306 is also configured to cause hardware in the beamforming transducers 106 and 108 to output audio beams in accordance with the directions and spatial constraints.

Figure 4:
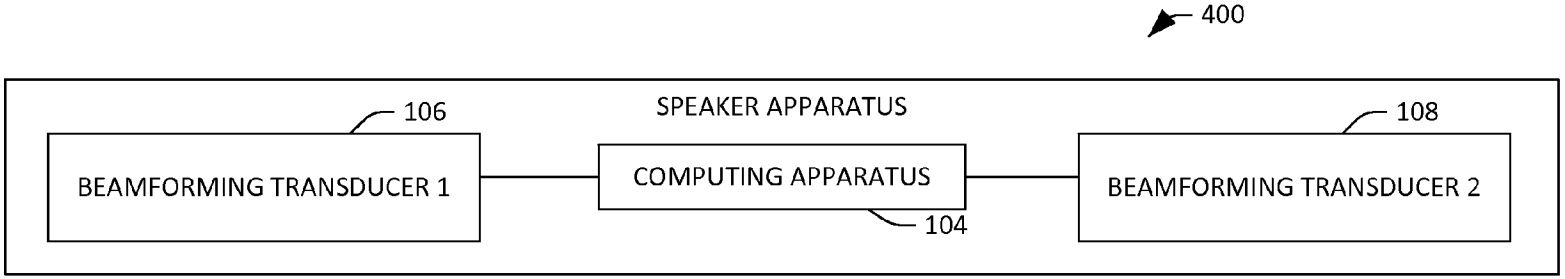
FIG. 4 illustrates an exemplary speaker apparatus.

With reference now to FIG. 4, an exemplary speaker apparatus 400 is illustrated. The speaker apparatus 400 includes the first beamforming transducer 106 and the second beamforming transducer 108, as well as the computing apparatus 104. For example, the speaker apparatus 400 may be a bar-type speaker, having a relatively long lateral length (e.g. 3 feet to 15 feet), wherein the first beamforming transducer 106 is located at a leftward portion of the speaker apparatus 400 and the second beamforming transducer 108 is located at a rightward portion of the speaker apparatus 400. While shown as being located in the center of the speaker apparatus 400, the computing apparatus 104 may be located in any suitable position in the speaker apparatus 400 or may be distributed throughout the speaker apparatus 400. Additionally, the location sensor 110 may be internal or external to the speaker apparatus 400. The computing apparatus 104 and the first and second beamforming transducers 106 and 108 can act in any of the manners described above.

Figure 5:
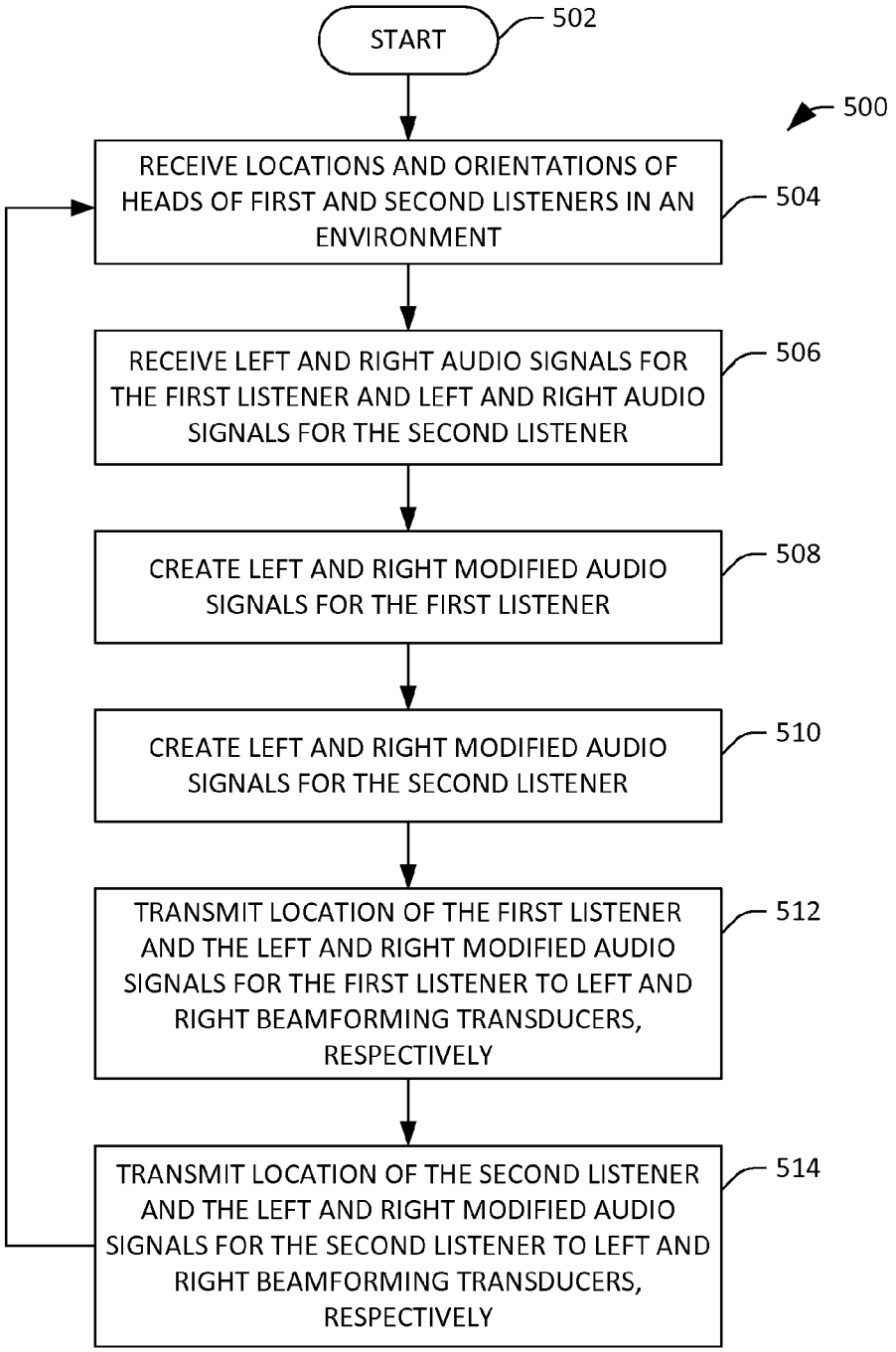
FIG. 5 illustrates an exemplary methodology for utilizing a combination of crosstalk cancellation and beamforming to improve an audio experience of multiple listeners in an environment.
Figure 6:
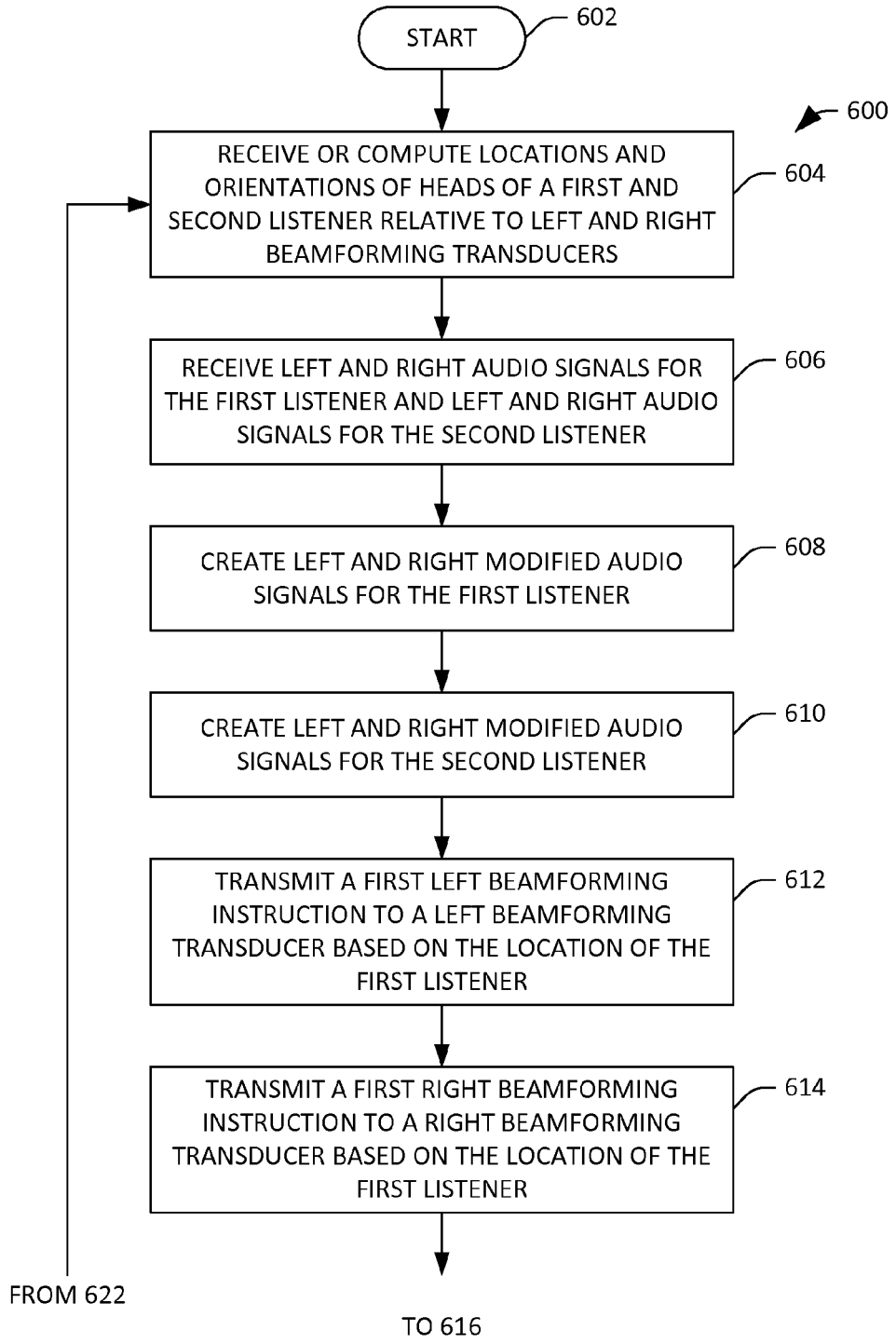
FIGS. 6 and 7 depict a flow diagram that illustrates an exemplary methodology that can be undertaken at a speaker apparatus for providing audio to listeners in an environment.
Figure 7:
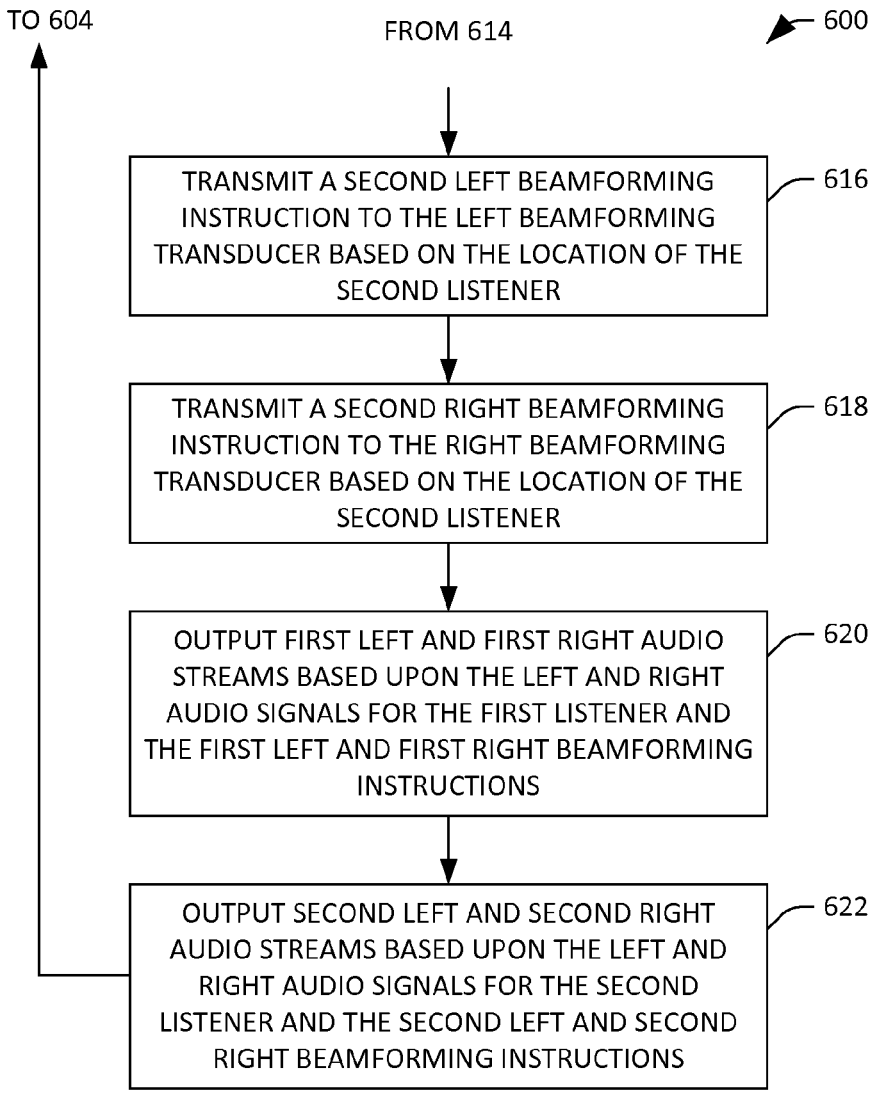

FIGS. 5-7 illustrate exemplary methodologies relating to facilitation of an immersive aural experience simultaneously to multiple listeners in an environment. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement a methodology described herein.

Moreover, the acts described herein may be computer-executable instructions that can be implemented by one or more processors and/or stored on a computer-readable medium or media. The computer-executable instructions can include a routine, a sub-routine, programs, a thread of execution, and/or the like. Still further, results of acts of the methodologies can be stored in a computer-readable medium, displayed on a display device, and/or the like.

Referring now to FIG. 5, an exemplary methodology 500 that can be executed by a computing apparatus that is in communication with a first beamforming transducer and a second beamforming transducer is illustrated. The methodology 500 starts at 502, and at 504, locations and orientations of heads (ears) of a first and second listener, respectively, in an environment are received. As noted above, a sensor can output data that is indicative of locations and orientations of the heads of the first and second listeners respectively, such as a depth image, an RGB image, etc. The locations and orientations of the heads of the respective listeners can be computed based upon the aforementioned images.

At 506, left and right audio signals for the first listener and left and right audio signals for the second listener are received. For example, an audio signal can be composed of a number of signals corresponding to respective transducers in the audio system. In the exemplary methodology 500, the audio system includes at least left and right beamforming transducer. Accordingly, the audio signal comprises left and right audio signals. Furthermore, as there are at least a first and second listener in the environment, an audio signal can be generated for each respective listener.

At 508, a suitable crosstalk cancellation algorithm can be executed over the left audio signal and the right audio signal for the first listener, thereby creating left and right modified audio signals for the first listener. At 510, the crosstalk cancellation algorithm can be executed over the left audio signal and the right audio signal for the second listener, thereby creating left and right modified audio signals for the second listener.

At 512, the location of the head of the first listener received at 504, as well as the left and right modified audio signals for the first listener created at 508, are transmitted to the left and right beamforming transducers, respectively. Accordingly, the left and right beamforming transducers can output audio beams directed to the head of the first listener, wherein such audio beams include cancellation components that are utilized to de-correlate audio at the ears of the first listener.

At 514, the location of the head of the second listener received at 504 and the left and right modified audio signals for the second listener created at 510 are transmitted to the left and right beamforming transducers, respectively. Thus, the left and right beamforming transducers can directionally transmit audio beams to the location of the head of the second listener, wherein each audio beam includes cancelling components that de-correlates audio at the ears of the second listener. The methodology 600 can repeat until there are no further audio signals to be presented to the first and second listener, or until one or both listeners exit the environment.

Now referring to FIG. 6 and FIG. 7, an exemplary methodology 600 that can be executed by a speaker apparatus, such as a bar speaker, is illustrated. The methodology 600 starts at 602, and at 604, locations and orientations of heads of a first and second listener, respectively, relative to left and right beamforming transducers are received. At 606, left and right audio signals for the first listener and left and right audio signals for the second listener are received. At 608, left and right modified audio signals are created for the first listener. As noted above, a crosstalk cancellation technique can be utilized to generate the left and right modified audio signal for the first listener based upon the location of the head of the first listener. Further, the left and right audio signals can be processed to provide personalized spatial effects for the first and second listener. At 610, left and right modified audio signals are created for the second listener based upon the location and orientation of the head of second listener.

At 612, a first left beamforming instruction is transmitted to a left beamforming transducer based upon the location of the head of the first listener. The first left beamforming instruction can indicate a direction and "tightness" of an audio beam to be transmitted by the left beamforming transducer (e.g., such that the audio beam is directed generally towards the head of the first listener). At 614, a first right beamforming instruction is transmitted to a right beamforming transducer based upon the location of the head of the first listener. The first right beamforming instruction can generally direct the right beamforming transducer to emit an audio beam towards the head of the first listener.

With reference to FIG. 7, the methodology 600 continues, and at 616, a second left beamforming instruction is transmitted to the left beamforming transducer based upon the location of the head of the second listener. Such instruction generally causes the left beamforming transducer to direct an audio beam towards the head of the second listener.

At 618, a second right beamforming instruction is transmitted to the right beamforming transducer based upon the location of the head of the second listener. Accordingly, the right beamforming transducer is instructed to direct an audio beam to the head of the second listener.

At 620, a first left audio beam and a first right audio beam are output from the left and right beamforming transducers, respectively, based upon the first left and right modified audio signals created at 608 and the first left and right beamforming instruction transmitted at 612 and 614, respectively. At 622, second left and second right audio beams are output by the left and right beamforming transducers, respectively, based upon the left and right audio signals for the second listener and second left and right beamforming instructions (for the second listener). The methodology 600 can repeat until one or more of the listeners leaves the environment or when there are no further audio signals.

Figure 8:
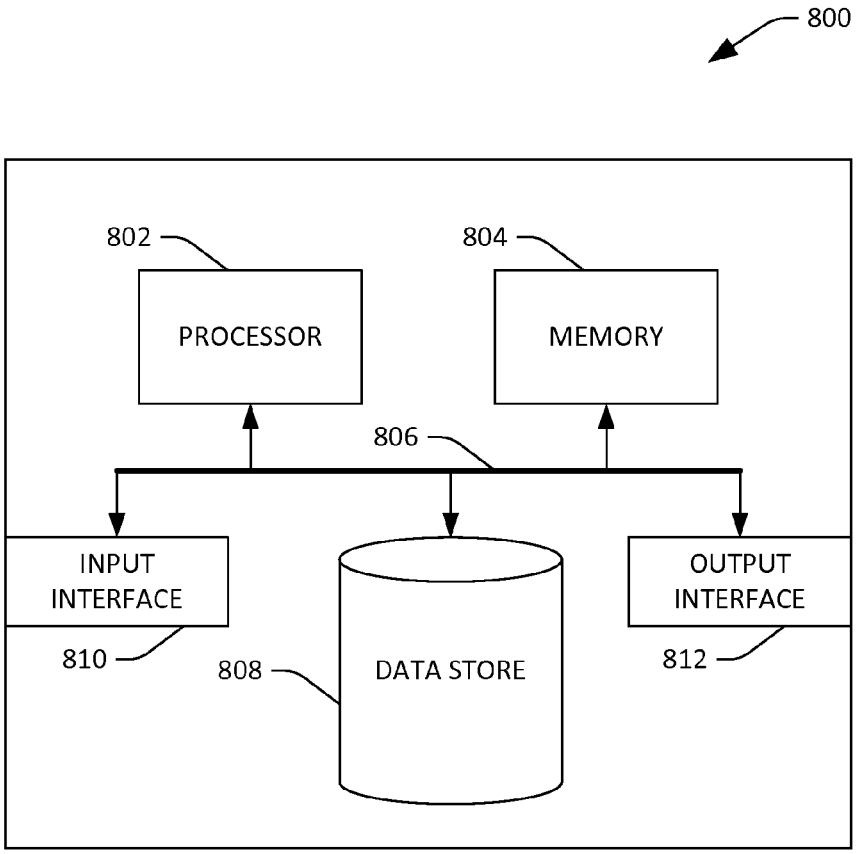
FIG. 8 is an exemplary computing apparatus.

Referring now to FIG. 8, a high-level illustration of an exemplary computing device 800 that can be used in accordance with the systems and methodologies disclosed herein is illustrated. For instance, the computing device 800 may be used in a system that supports utilizing location and orientation tracking, crosstalk cancellation, and beamforming to improve an aural experience of multiple listeners in an environment. The computing device 800 includes at least one processor 802 that executes instructions that are stored in a memory 804. The instructions may be, for instance, instructions for implementing functionality described as being carried out by one or more components discussed above or instructions for implementing one or more of the methods described above. The processor 802 may access the memory 804 by way of a system bus 806. In addition to storing executable instructions, the memory 804 may also store audio files, audio signals, sensor data, etc.

The computing device 800 additionally includes a data store 808 that is accessible by the processor 802 by way of the system bus 806. The data store 808 may include executable instructions, images, audio files, audio signals, etc. The computing device 800 also includes an input interface 810 that allows external devices to communicate with the computing device 800. For instance, the input interface 810 may be used to receive instructions from an external computer device, from a user, etc. The computing device 800 also includes an output interface 812 that interfaces the computing device 800 with one or more external devices. For example, the computing device 800 may display text, images, etc. by way of the output interface 812.

It is contemplated that the external devices that communicate with the computing device 800 via the input interface 810 and the output interface 812 can be included in an environment that provides substantially any type of user interface with which a user can interact. Examples of user interface types include graphical user interfaces, natural user interfaces, and so forth. For instance, a graphical user interface may accept input from a user employing input device(s) such as a keyboard, mouse, remote control, or the like and provide output on an output device such as a display. Further, a natural user interface may enable a user to interact with the computing device 800 in a manner free from constraints imposed by input device such as keyboards, mice, remote controls, and the like. Rather, a natural user interface can rely on speech recognition, touch and stylus recognition, gesture recognition both on screen and adjacent to the screen, air gestures, head and eye tracking, voice and speech, vision, touch, gestures, machine intelligence, and so forth.

Additionally, while illustrated as a single system, it is to be understood that the computing device 800 may be a distributed system. Thus, for instance, several devices may be in communication by way of a network connection and may collectively perform tasks described as being performed by the computing device 800.

Various functions described herein can be implemented in hardware, software, or any combination thereof. If implemented in software, the functions can be stored on or transmitted over as one or more instructions or code on a computer-readable medium. Computer-readable media includes computer-readable storage media. A computer-readable storage media can be any available storage media that can be accessed by a computer. By way of example, and not limitation, such computer-readable storage media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, include compact disc (CD), laser disc, optical disc, digital versatile disc (DVD), floppy disk, and Blu-ray disc (BD), where disks usually reproduce data magnetically and discs usually reproduce data optically with lasers. Further, a propagated signal is not included within the scope of computer-readable storage media. Computer-readable media also includes communication media including any medium that facilitates transfer of a computer program from one place to another. A connection, for instance, can be a communication medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio and microwave are included in the definition of communication medium. Combinations of the above should also be included within the scope of computer-readable media.

Alternatively, or in addition, the functionally described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. A method, comprising:

receiving data that is indicative of locations of respective ears of a first listener and ears of a second listener in an environment;

receiving a binaural audio signal that comprises a first audio signal that is to be directed to left ears and a second audio signal that is to be directed to right ears;

dynamically generating left audio signals and right audio signals based upon:

the data that is indicative of locations of the respective ears of the first listener and the ears of the second listener, a binaural late reverberation signal that is to be provided to both the first listener and the second listener, and the binaural audio signal, wherein the left audio signals represent audio to be output by a first beamforming transducer, and the right audio signals represent audio to be output by a second beamforming transducer;

transmitting the left audio signals to the first beamforming transducer; and transmitting the right audio signals to the second beamforming transducer, wherein audio beams output by the first beamforming transducer and the second beamforming transducer responsive to receipt of the left audio signals and the right audio signals, respectively, include cancelling components that de-correlate audio at the ears of the first listener and the ears of the second listener and provide both shared and customized spatial audio effects for the first listener and the second listener, the shared spatial audio effects based upon the binaural late reverberation signal, the customized spatial audio effects based upon the binaural audio signal and the data that is indicative of the locations of the respective ears of the first listener and the ears of the second listener.

2. The method of claim 1, the left audio signals comprising a first left audio signal and a second left audio signal that is different from the first left audio signal, the first beamforming transducer directing a first left audio beam to the first listener based upon the first left audio signal, and the first beamforming transducer directing a second left audio beam to the second listener based upon the second left audio signal.

3. The method of claim 2, further comprising:

transmitting the data that is indicative of the locations of the ears of the first listener and the ears of the second listener to the first beamforming transducer.

4. The method of claim 3, the right audio signals comprising a first right audio signal and a second right audio signal that is different from the first right audio signal, the second beamforming transducer directing a first right audio beam to the first listener based upon the first right audio signal, and the second beamforming transducer directing a second right audio beam to the second listener based upon the second right audio signal.

5. The method of claim 4, further comprising:

transmitting the data that is indicative of the locations of the ears of the first listener and the ears of the second listener to the second beamforming transducer.

6. The method of claim 1, further comprising:

receiving a video stream from a video camera, the first listener and the second listener captured in the video stream;

detecting the first listener and the second listener in the video stream; and computing the data that is indicative of the locations of the respective ears of the first listener and the ears of the second listener based upon the detecting of the first listener and the second listener in the video stream.

7. The method of claim 6, further comprising:

receiving data from a depth sensor; and computing the data that is indicative of the locations of the respective ears of the first listener and the ears of the second listener based upon the data received from the depth sensor.

8. The method of claim 1, configured for execution by a video game console.

9. The method of claim 1, wherein the data that is indicative of the locations of the respective ears of the first listener and the ears of the second listener comprises an image that captures the first listener and the second listener, the method comprising:

recognizing existence of faces of the first and second listeners, respectively, in the image;

responsive to recognizing the existence of the faces in the image, estimating respective poses of the faces in the image; and estimating the locations of the respective ears of the first listener and the ears of the second listener based upon the respective poses of the faces in the image.

10. The method of claim 1, the left audio signals and the right audio signals configured to cause the first beamforming transducer and the second beamforming transducer, respectively, to emit audio over an ultrasonic carrier frequency.

11. An audio system, comprising:

a computing apparatus that is in communication with a sensor, a first beamforming transducer, and a second beamforming transducer, the computing apparatus comprises:

at least one processor; and memory that stores instructions that, when executed by the at least one processor, causes the at least one processor to perform acts comprising:

determining, based upon data output by the sensor, locations and orientations of respective heads of a first listener and a second listener relative to locations of the first beamforming transducer and the second beamforming transducer;

receiving a first audio signal for the first listener and a second audio signal for the second listener, the first audio signal being different from the second audio signal;

generating customized audio signals for the first listener and customized audio signals for the second listener, wherein the customized audio signals for the first listener is based upon the first audio signal and the location and orientation of the head of the first listener, the customized audio signals for the first listener includes a binaural late reverberation signal, and wherein the customized audio signals for the second listener is based upon the second audio signal and the location and orientation of the head of the second listener, the customized audio signals for the second listener includes the binaural late reverberation signal; and transmitting the customized audio signals to the first beamforming transducer and the second beamforming transducer.

12. The audio system of claim 11, wherein the customized audio signals for the first listener comprise a first left customized signal and a first right customized signal, the customized audio signals for the second listener comprise a second left customized signal and a second right customized signal, wherein transmitting the customized audio signals to the first beamforming transducer and the second beamforming transducer comprises:

simultaneously transmitting the first left customized signal and the second left customized signal to the first beamforming transducer; and simultaneously transmitting the first right customized signal and the second right customized signal to the second beamforming transducer.

13. The audio system of claim 12, the first beamforming transducer comprises a first plurality of speakers, the second beamforming transducer comprises a second plurality of speakers, the acts further comprising:

transmitting the locations of the respective heads of the first listener and the second listener to the first beamforming transducer and the second beamforming transducer, wherein responsive to receiving the customized audio signals and the locations of the respective heads of the first listener and the second listener, the first beamforming transducer directs a first left audio beam to the first listener and a second left audio beam to the second listener, and the second beamforming transducer directs a first right audio beam to the first listener and a second right audio beam to the second listener.

14. The audio system of claim 13 comprising a bar speaker, the bar speaker comprising the computing apparatus, the first beamforming transducer, and the second beamforming transducer.

15. The audio system of claim 13, the computing apparatus being one of a video game console or a mobile computing apparatus.

16. The audio system of claim 11, wherein the data output by the sensor comprises at least one red-green-blue image that captures the first listener and the second listener, wherein the locations of the respective heads of the first listener and the second listener are determined based upon the at least one image.

17. The audio system of claim 16, wherein generating the customized audio signals for the first listener and the second listener comprises:

applying a first filter to the first audio signal; and applying a second filter to the second audio signal, the first and second filter being different.

18. The audio system of claim 11, the acts further comprising generating customized audio signals as location of at least one of the first listener or the second listener alters in the environment over time.

19. The audio system of claim 11, wherein generating the customized audio signals for the first listener and the second listener comprises:

applying a crosstalk cancellation algorithm over the first audio signal and the second audio signal.

20. A computer-readable storage medium comprising instructions that, when executed by a processor, cause the processor to perform acts comprising:

determining a location and orientation of a head of a first listener relative to a first beamforming transducer and a second beamforming transducer, respectively, the first beamforming transducer comprising a first plurality of speakers, the second beamforming transducer comprising a second plurality of speakers;

determining a location and orientation of a head of a second listener relative to the first beamforming transducer and the second beamforming transducer, respectively;

receiving a first audio signal for the first listener, the first audio signal comprising a first left audio signal to be transmitted to the first beamforming transducer and a first right audio signal to be transmitted to the second beamforming transducer;

receiving a second audio signal for the second listener, the second audio signal comprising a second left audio signal to be transmitted to the first beamforming transducer and a second right audio signal to be transmitted to the second beamforming transducer;

performing crosstalk cancellation on the first audio signal based on the location and orientation of the head of the first listener, thereby generating a modified first left audio signal and a modified first right audio signal;

performing crosstalk cancellation on the second audio signal based on the location and orientation of the head of the second listener, thereby generating a modified second left audio signal and a modified second right audio signal;

transmitting, to the first beamforming transducer, the modified first left audio signal, the modified second left audio signal, a left late reverberation signal, the location of the head of the first listener, and the location of the head of the second listener, wherein a first beam emitted by the first beamforming speaker and directed to the first listener includes the modified first left audio signal and the left late reverberation signal, and wherein a second beam emitted by the first beamforming speaker and directed to the second listener includes the modified second left audio signal and the left late reverberation signal; and transmitting, to the second beamforming transducer, the modified first right audio signal, the modified second right audio signal, a right late reverberation signal, the location of the head of the first listener, and the location of the head of the second listener, wherein a first beam emitted by the second beamforming speaker and directed to the first listener includes the modified first right audio signal and the right late reverberation signal, and wherein a second beam emitted by the second beamforming speaker and directed to the second listener includes the modified second right audio signal and the right late reverberation signal.

* * * * *